US012044508B2

(12) United States Patent
Thompson et al.

(10) Patent No.: US 12,044,508 B2
(45) Date of Patent: Jul. 23, 2024

(54) COVER FOR BALLISTIC CARRIER

(71) Applicant: Fechheimer Brothers Company, Cincinnati, OH (US)

(72) Inventors: Jesse Brian Thompson, North Bend, WA (US); Kevin Ray Klemmt, Renton, WA (US)

(73) Assignee: Fechheimer Brothers Company, Cincinnati, OH (US)

( * ) Notice: Subject to any disclaimer, the term of this patent is extended or adjusted under 35 U.S.C. 154(b) by 210 days.

(21) Appl. No.: 17/805,243

(22) Filed: Jun. 3, 2022

(65) Prior Publication Data

US 2022/0390210 A1 Dec. 8, 2022

Related U.S. Application Data

(60) Provisional application No. 63/196,280, filed on Jun. 3, 2021.

(51) Int. Cl.
*F41H 1/02* (2006.01)
*A41D 1/04* (2006.01)

(52) U.S. Cl.
CPC ..... *F41H 1/02* (2013.01); *A41D 1/04* (2013.01)

(58) Field of Classification Search
CPC ..... F41H 1/02; A41D 1/04
See application file for complete search history.

(56) References Cited

U.S. PATENT DOCUMENTS 3,452,362 A * 7/1969 Korolick ..... F41H 1/02 2/92
5,073,985 A * 12/1991 Stone ..... F41H 1/02 2/92
5,331,683 A 7/1994 Stone et al.
5,991,925 A * 11/1999 Wu ..... A41D 13/0012 224/931
6,185,738 B1 * 2/2001 Sidebottom ..... F41H 1/02 2/2.5
7,424,748 B1 * 9/2008 McDunn ..... F41H 1/02 2/2.5
8,528,112 B2 9/2013 Blauer et al.
8,776,262 B2 7/2014 Blauer et al.
9,826,816 B1 * 11/2017 Chang ..... A45F 3/08
9,835,414 B2 12/2017 Blauer et al.
10,060,707 B2 * 8/2018 Searle ..... A41D 1/04
10,139,199 B2 11/2018 Blauer et al.
10,485,272 B2 11/2019 Blauer et al.
11,083,278 B2 * 8/2021 Villaruz ..... A41D 13/0007
(Continued)

FOREIGN PATENT DOCUMENTS

WO 2012138684 A2 10/2012

*Primary Examiner* — Khaled Annis
(74) *Attorney, Agent, or Firm* — Wood Herron & Evans LLP

(57) ABSTRACT

Provided is a cover for use with a ballistic panel carrier having front and rear carrier panels interconnected by shoulder straps. The cover includes front and rear outer cover shell components, together defining a neck opening between shoulder portions and having sides that, when sides of the ballistic panel carrier are secured together, define arm opening edges. A yoke lining component is attached to the outer cover shell components at the neck opening and separably attached to the outer cover shell components along at least portions of the arm opening edges.

5 Claims, 2 Drawing Sheets

(56) References Cited

U.S. PATENT DOCUMENTS 11,779,064 B2 * 10/2023 Martinez ..... A41D 13/0568 2/463
2005/0050608 A1 * 3/2005 Jones ..... G21F 9/001 2/102
2010/0142328 A1 * 6/2010 Beck ..... F41J 5/06 367/129
2012/0124713 A1 * 5/2012 Blauer ..... F41H 1/02 2/102
2012/0246788 A1 * 10/2012 Harrell ..... A41D 13/0155 2/243.1
2014/0261862 A1 * 9/2014 Atkinson, Jr. ..... A01C 7/02 141/2
2015/0342329 A1 * 12/2015 Formosa ..... A41D 13/0012 2/102
2016/0116255 A1 4/2016 Billotte
2016/0187103 A1 * 6/2016 Coats ..... G01N 3/313 2/2.5
2016/0238347 A1 * 8/2016 Blauer ..... A41D 3/005
2016/0273882 A1 * 9/2016 Coats ..... G01N 3/313
2017/0082404 A1 * 3/2017 Blauer ..... F41H 1/02
2017/0156415 A1 * 6/2017 Winner ..... A41D 13/1245
2017/0231299 A1 * 8/2017 Feterman ..... A45C 13/123 224/153
2017/0291098 A1 * 10/2017 Farris ..... A41D 13/0556
2017/0354530 A1 * 12/2017 Shagdar ..... A41D 31/18
2018/0128577 A1 * 5/2018 Beck ..... F41H 5/0478
2018/0160744 A1 * 6/2018 Blauer ..... F41H 1/02
2018/0372452 A1 * 12/2018 MacNeil ..... F41H 1/02
2020/0189698 A1 * 6/2020 Harland ..... B63C 9/1255
2020/0355469 A1 * 11/2020 Becker ..... F41H 5/013
2021/0120890 A1 * 4/2021 Tokunaga ..... A41D 27/28
2022/0022562 A1 * 1/2022 Simmons ..... A41D 1/04
2022/0390210 A1 * 12/2022 Thompson ..... A41D 1/04

* cited by examiner

COVER FOR BALLISTIC CARRIER

RELATED APPLICATIONS

This application claims the benefit of priority to U.S. Provisional Patent Application Ser. No. 63/196,280, filed on Jun. 3, 2021, the disclosure of which is incorporated by reference herein.

TECHNICAL FIELD

This invention relates to covers used with carriers for soft or hard ballistic panels and in particular to covers used with vest-like carriers supporting ballistic panels for protection of a wearer or user such as a law enforcement officer.

BACKGROUND

It is known to use a vest-like support for supporting ballistic panels of various hard and soft materials, such as those typically utilized against ballistic threats toward military, law enforcement, security or other personnel. When worn on the outside of clothing, such supports have a "tactical," operational, or military look. It also covers front pockets, epaulettes, and other utilitarian features of the upper body uniform. Wearing a ballistic vest under clothing can be uncomfortable and requires uniform clothing to be oversized to accommodate the thickness of the ballistic vest.

Various entities have attempted to provide covers for these supports, such as those shown in U.S. Pat. Nos. 5,331,683; 8,528,112; and 8,776,262. Such prior covers provide more of an ordinary uniform look than the more tactical-appearing ballistic panel supports. The cover can have the appearance of a uniform and include utilitarian features, such as breast pockets and epaulettes on the outer surface. The shirt worn under the carrier can have sleaves that match the uniform appearance of the cover, while the torso is plain, smooth, and comfortable to the wearer. The cover helps keep the ballistic panel carrier clean and a user can have multiple covers for their single carrier so that the covers can be changed and laundered separately.

Properly adjusted fit of the ballistic carrier may be critical for assuring life-protecting performance, so it is important that the cover not interfere with the fit or adjustment of the carrier while being worn, as well as while installing the cover onto the carrier. Such prior covers have required the shoulder straps of the ballistic carrier, which is a critical fit adjustment, to be separated and threaded through loops or tunnels at the shoulders of the cover to assemble the cover to the carrier.

Accordingly, it is desirable to provide a ballistic carrier cover that can be assembled to the carrier without disassembly or separation of the carrier's properly adjusted shoulder straps.

SUMMARY OF THE INVENTION

The present invention provides a cover for use with a ballistic panel carrier having front and rear carrier panels interconnected by shoulder straps. The cover includes front and rear outer cover shell components, together defining a neck opening between shoulder portions and having sides that, when sides of the ballistic panel carrier are secured together, define arm opening edges. A yoke lining component is attached to the outer cover shell components at the neck opening and separably attached to the outer cover shell components along at least portions of the arm opening edges.

The cover is for use with a ballistic panel carrier having front and rear carrier panels interconnected by shoulder straps. The cover is attachable to a carrier to fully enclose the shoulder straps without requiring separation of the shoulder straps during installation. The yoke lining may be separably attachable to the outer shell components along at least portions of the arm opening edges, such as with zippers.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
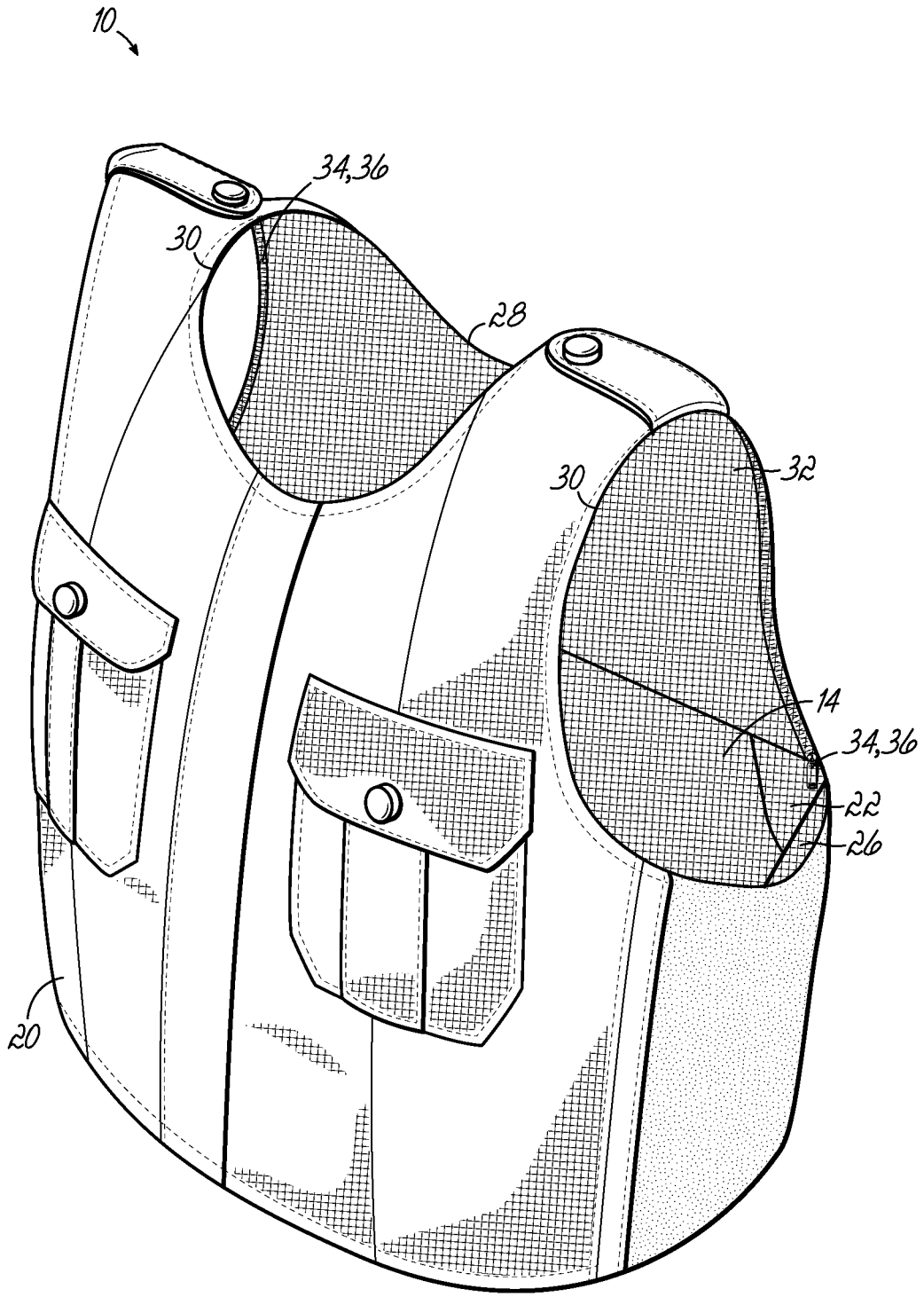
FIG. 1 is an illustrative view of a cover according to an embodiment of the present invention installed over a ballistic carrier.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring to FIG. 1, therein is shown a ballistic carrier cover 10 according to one embodiment of the invention. The ballistic carrier cover 10 is intended to cover a ballistic panel carrier, not to act as a ballistic carrier. The ballistic panel carrier includes a front carrier panel 12 and rear carrier panel 14, which are interconnected at the top by adjustable shoulder straps 16. The rear carrier panel 14 may include lateral extensions 18 that connect with sides of the front carrier panel 12 in a well-known manner. The ballistic carrier cover 10 does not interfere with the way in which the carrier adjusts or connects for wearing and proper fit. The shoulder straps 16 may adjust by any desired means, typically by separable hook and pile fastener material. Likewise, the lateral extensions 18 may adjustable connect to sides of the front carrier panel 12 by any desired means, typically by separable hook and pile fastener material.

The ballistic carrier cover 10 includes an front outer cover shell 20 and an rear outer cover shell 22. Each of the front and rear outer cover shells 20, 22 may include a respective inner front and inner rear lining 24, 26 which define pockets for receiving the front and rear carrier panels 12, 14 of the carrier. The front and rear outer cover shells 20, 22 are connected at shoulder portions and define a neck opening 28. When the carrier is joined at the sides, the front and rear outer cover shells 20, 22 define arm openings 30. A yoke-like lining 32 is attached around the neck opening 28, such as by sewing, and extends over the shoulders and partially down over upper portions of the carrier front and rear carrier panels 12, 14.

Figure 2:
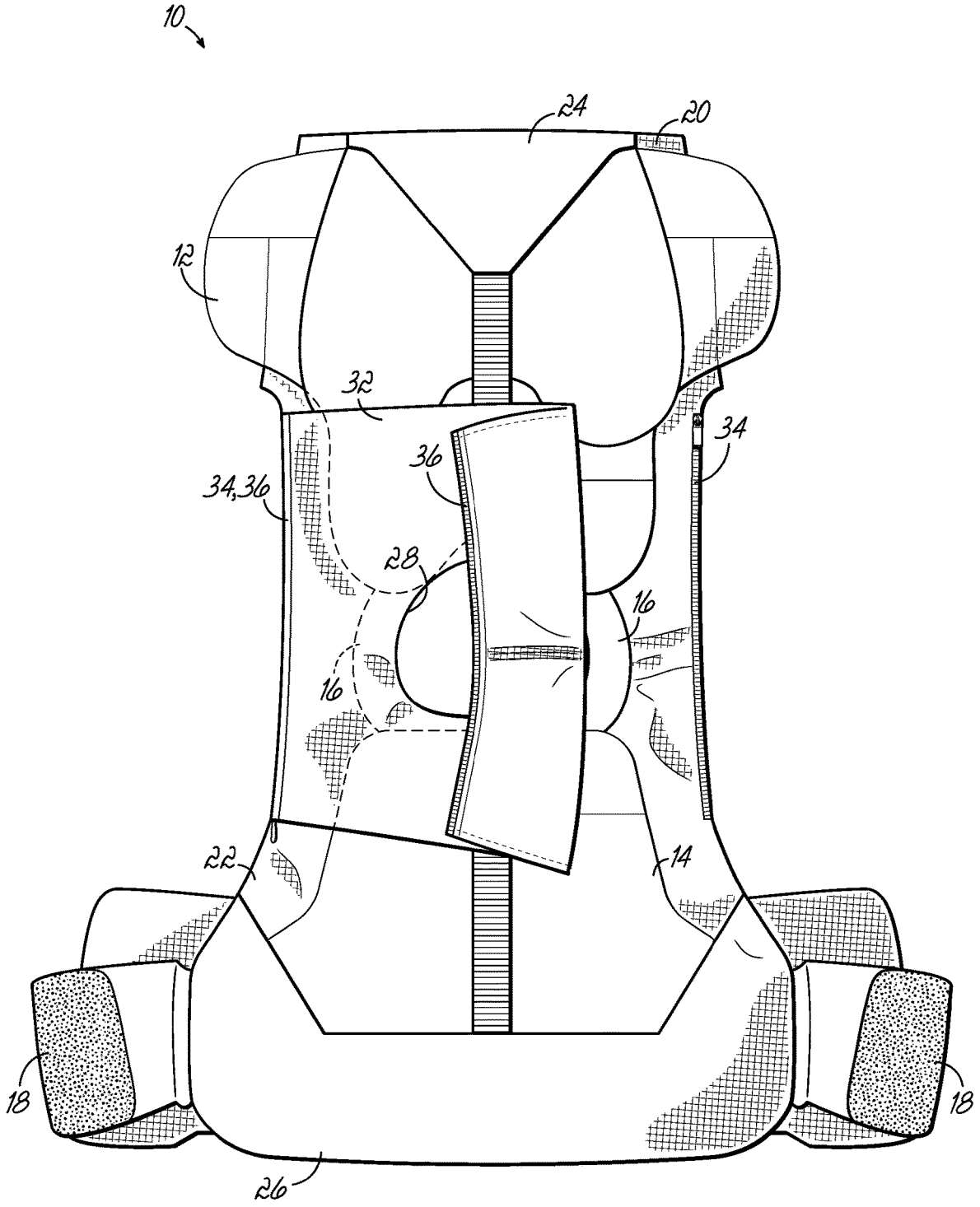
FIG. 2 is an opened, inside view showing assembly of the cover to a carrier.

One aspect of the present invention is the separable manner in which the yoke lining 32 detachably attaches to the front and rear outer cover shells 20, 22 around the perimeter of the arm openings 30. In one embodiment, the attachment is in the form of a separable zipper (opposite sides shown schematically at 34, 36). Other types of separable attachment may be used as well. In FIG. 2, one of the zippers 34, 36 is shown closed and the other is shown open and separated.

According to one aspect of the invention, to install the cover 10 on the front and rear carrier panels 12, 14, and the shoulder straps 16, the zippers parts 34, 36 are separated and the yoke lining 32 is passed between the shoulder straps 16 that connect the front and rear carrier panels 12, 14. The front and rear carrier panels 12, 14 are then inserted into the pockets formed between the front outer cover shell 20 and inner front lining 24, and the rear outer cover shell 22 and inner rear lining 26, respectively. The yoke lining 32 is spread into place over the shoulder straps 16 and upper portions of the front and rear carrier panels 12, 14 of the carrier and the zipper parts 34, 36 are closed (i.e., zipped). This completely contains and encloses the shoulder straps 16 without them having to be separated and reattached/readjusted. Because the zipper 34, 36 is located at the edge of the arm opening 30, it does not interfere with the other functions of the carrier or cover 10, presents a neat appearance, and does not uncomfortably bear against the user's body. The covered carrier is then donned in the usual manner.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A cover for use with a ballistic panel carrier having front and rear carrier panels interconnected by shoulder straps, wherein said cover comprises:

front and rear outer cover shells, together defining a neck opening between shoulder portions and having sides that, when the sides of the ballistic panel carrier are secured together, define sleeveless arm openings each having an arm opening edge; and a yoke lining attached to the front and rear outer cover shells around the neck opening and separably attached to the front and rear outer cover shells along at least upper portions of the arm opening edges.

2. The cover of claim 1, further comprising an inner front lining and an inner rear lining.

3. The cover of claim 1, wherein the yoke lining attaches to front and rear outer cover shells with separable zippers along the at least upper portions of the arm opening edges.

4. The cover of claim 1, wherein the yoke lining includes portions extending from the neck opening inside at least a portion of the front and rear outer cover shells.

5. A method of assembling a cover onto a ballistic panel carrier having front and rear carrier panels interconnected by shoulder straps, comprising:

providing a cover having front and rear outer cover shells, together defining a neck opening between shoulder portions and having sides that, when the sides of the ballistic panel carrier are secured together, define sleeveless arm openings each having an arm opening edge and a yoke lining attached to the front and outer cover shells around the neck opening and separably attached to the front and rear outer cover shells along at least upper portions of the arm opening edges;

separating and the yoke lining from the front and rear outer cover shells at the arm opening edges;

passing the yoke lining between the shoulder straps that connect the front and rear panels of the ballistic panel carrier; and extending the yoke lining to cover the shoulder straps and attaching the yoke lining to the front and rear outer cover shells along at least upper portions of the arm opening edges.

* * * * *